US005528989A

United States Patent [19]

Briese

[11] Patent Number: 5,528,989

[45] Date of Patent: Jun. 25, 1996

[54] HIGHLY SEPARABLE BULLET

[76] Inventor: Torrey L. Briese, R.R. 1, Box 108, Tappen, N. Dak. 58487

[21] Appl. No.: 291,391

[22] Filed: Aug. 15, 1994

Related U.S. Application Data

[63] Continuation-in-part of Ser. No. 52,513, Apr. 29, 1993, abandoned.

[51] Int. Cl.[6] ..... F42B 12/00; F42B 12/34

[52] U.S. Cl. ..... 102/506; 102/501; 102/516; 102/517

[58] Field of Search ..... 102/474, 501, 102/506–510, 514–518, 529

[56] References Cited

U.S. PATENT DOCUMENTS

| | | | |
|---|---|---|---|
| 2,958,287 | 11/1960 | Auxier | 102/507 |
| 3,097,603 | 7/1963 | Harper | 102/506 |
| 3,143,966 | 8/1964 | Burns, Jr. et al. | 102/507 |
| 3,173,371 | 3/1965 | Manshel | 102/516 |
| 3,208,386 | 9/1965 | Schneider et al. | 102/506 |
| 4,048,922 | 9/1977 | Buljovcic | 102/501 |
| 4,703,696 | 11/1987 | Bocker | 102/517 |
| 4,710,280 | 12/1987 | Brilmyer et al. | 204/146 |
| 4,774,889 | 10/1988 | Wallow et al. | 102/517 |
| 4,805,536 | 2/1989 | Kosteck | 102/514 |
| 4,836,110 | 6/1989 | Burczynski | 102/508 |
| 4,897,117 | 1/1990 | Penrice | 102/518 |
| 4,913,054 | 4/1990 | Petersen | 102/439 |
| 4,947,755 | 8/1990 | Burczynski | 102/506 |

FOREIGN PATENT DOCUMENTS

| | | | |
|---|---|---|---|
| 72702 | 1/1894 | Germany | 102/506 |
| 3819251 | 12/1989 | Germany | 102/439 |
| 3840165 | 7/1990 | Germany | 102/510 |
| 17152 | of 1899 | United Kingdom | 102/514 |

*Primary Examiner*—Harold J. Tudor

[57] ABSTRACT

A highly separable bullet which disintegrates in a controlled fashion is provided, which highly separable bullet comprises a bullet core and a jacket, and which highly separable bullet is fabricated by method comprising a three step low-impact swaging process. A highly separable bullet is provided which easily, consistently, and predictably separates, fragments and disintegrates in a controlled fashion after entering soft tissue, water or ballistic geletin as such. The first step bullet core swaging process is a low-impact swaging process comprising placing a preselected number of a plurality of malleable strands of metal in a bullet core swaging die and swaging the plurality of malleable strands of the bullet core into a cylindrical core having a unique, uniform interlocking pattern between the plurality of malleable strands of metal. A second step of the low-impact swaging process comprises placing the cylindrical core in the jacket and swaging the jacket and the cylindrical core within the jacket a second time in a conforming die, which swaging in the conforming die forms the cylindrical core to the identification of the jacket of the highly separable bullet. A third step of the low-impact swaging process comprises the utilization of a point forming die which transforms the jacket and the bullet core within the jacket into the final desired highly separable bullet shape.

1 Claim, 5 Drawing Sheets

HIGHLY SEPARABLE BULLET

BACKGROUND OF THE INVENTION

This application is a continuation-in-part of application Ser. No. 08/052,513, filed Apr. 29, 1993 now abandoned.

The present invention relates to novel bullet constructions, and more specifically to a highly separable bullet, accurately described as a controlled disintegrating bullet, and a method of fabrication thereof.

Conventional bullets include many different types of cores and methods of making such bullets. However, no conventional bullets provide for a highly separable bullet which fragments in soft tissue, water or ballistic geletin as such in a controlled disintegration, nor a method of making such a bullet, both of which are provided for in the present invention.

In addition to those identified in co-pending application Ser. No. 08/052,513, known is an IMPROVEMENTS IN COMPOUND BULLETS, British Patent No. 17,152, which teaches a bullet having a hard metal envelope and a core of lead or lead alloy, with the core cut from the front end parallel to the longitudinal axis of the bullet into a number of divisions which do not extend to the base of the bullet, specifically teaching that the cut should not extend so close to the base as to be able to break away from each other during manufacture, i.e., ⅔ to ¾ length of bullet from the nose, and no closer than 3/16" from the base of the bullet. Unlike the present invention and method, a bullet fabricated by this method is not formed using a plurality of malleable strands of metal and will not separate and disintegrate in the controlled fashion of the present invention.

Also known is a PROJECTILE, U.S. Pat. No. 2,958,287, which teaches in essence a partition bullet, which projectile has a one-piece jacket of elongated tubular construction having a closed base and a tapered nose, and a cup-like partition member intermediate the length of the projectile jacket for the purpose of dividing the core of the jacket into nose and heel sections, which jacket is filled with a metallic core both forward and rearward of the partition, which metallic core will flatten or mushroom in the nose portion upon impact. Unlike the present invention a projectile of this type is not formed using a plurality of malleable strands of metal, is not formed by means of a three step low impact swaging process and will not separate and disintegrate in a controlled fashion as the present invention.

Also known is a STRIP BULLET, U.S. Pat. No. 3,208,386, which teaches a composite projectile and method of controlled fragment dispersion thereof, which composite projectile is constructed to fragment, separate and disperse at close range when fired from a gun. The projectile has a number of elongated metal segments and a metal base cup or half-jacket with the segments being fitted into the base cup or half-jacket and then swaged with the base cup or half-jacket into the final projectile in a one-step method of fabrication. Specifically taught is a bullet that separates by centrifugal force upon being fired unlike the present invention which specifically does not separate by centrifugal force. Unlike the present invention a bullet of this type is not formed by means of a three step low impact swaging process and will not separate and disintegrate in a controlled fashion as the present invention.

None of the art as described above describe a highly separable bullet capable of controlled disintegration and a method of fabrication thereof, which highly separable bullet has a bullet core formed from a plurality of malleable strands of metal swaged to form a substantially cylindrical core which easily fragments in a controlled disintegration in soft tissue, water or ballistic geletin as such. The present invention provides a bullet which will normally not exit water, soft tissue or ballistic geletin as such unlike the prior art and which separates and fragments in a more predictable manner than any conventional bullets.

SUMMARY OF THE INVENTION

The present invention relates to a highly separable bullet of any caliber which disintegrates in a controlled manner and a method of fabrication thereof, which bullet comprises a bullet core made from a plurality of malleable strands of metal of approximately equal length and diameter swaged into a metal jacket by means of a method of fabrication which method comprises a three step low-impact swaging process.

The bullet core further comprises a plurality of malleable strands of metal such as lead, lead alloy, or other such malleable metal, all of which plurality of malleable strands of metal are of equal length and diameter with each other and are swaged into a substantially cylindrical core, which cylindrical core has a unique, uniform interlocking pattern between the plurality of malleable strands of metal. The plurality of malleable strands of metal are of varying diameter and length as determined by the caliber and weight of the highly separable bullet in relation to the purpose for which the highly separable bullet is to be utilized. The method of fabrication is the same regardless of the caliber and weight of the bullet being fabricated. Optimal results can be obtained when the plurality of malleable strands of metal comprises two to ten strands for most common bullet calibers and weights, but use of more than ten strands is possible. One embodiment of the highly separable bullet comprises a plurality of malleable strands of metal having the combination of lead and 1½% Sb Antimony, said plurality of malleable strands of metal being of varying diameter and cut to a predetermined length as determined by the caliber and weight of the highly separable bullet in relation to the purpose for which the highly separable bullet is to be utilized. The highly separable bullet has a jacket which encloses and constrains the bullet core and provides shape for the highly separable bullet.

A method of fabricating the highly separable bullet is provided whereby a three step low-impact swaging process is utilized to produce the final highly separable bullet. The first step of the low-impact swaging process is a bullet core swaging process which is a low-impact swaging process comprising placing a preselected number of the plurality of malleable strands of metal in a bullet core swaging die of appropriate dimension and swaging the plurality of malleable strands of the bullet core into a cylindrical core having a unique, uniform interlocking pattern between the plurality of malleable strands of metal, such bullet core swaging process causing the plurality of malleable strands of metal to coalesce and interlock into the cylindrical core. The bullet core swaging process further comprises securing a stripper punch in a first end of the bullet core swaging die, which stripper punch securely holds a plurality of first ends of the plurality of malleable strands of metal in position throughout the bullet core swaging process. A minute amount of lubricant is applied to the plurality of malleable strands of metal positioned in the bullet core swaging die. A top punch is positioned in a second end of the bullet core swaging die, and pressure is slowly and uniformly applied by means of the top punch to a plurality of second ends of the plurality of malleable strands of metal positioned in the bullet core swaging die. The plurality of first ends of the plurality of malleable strands of metal are securely held in place by the stripper punch as pressure is applied by means of the top punch. Pressure applied by means of the top punch causes the plurality of malleable strands of metal to transform into a cylindrical core having a uniform, consistent bend interlocking pattern within the interior center of the bullet core swaging die. The uniform, consistent bend interlocking pattern consists of the center length of each and every of the plurality of malleable strands of metal individually and uniformly bending in the same direction and to the same degree as the pressure is slowly and uniformly applied by means of the top punch. The bullet core swaging die has a plurality of "bleed" holes which radiate from the interior of the bullet core swaging die to the exterior of the bullet core swaging die, which "bleed" holes are located and exit circumferentially from the interior to the exterior of the bullet core swaging die at the midlength of the bullet core swaging die. As pressure is slowly and uniformly applied by means of the top punch, the center lengths of each and every of the plurality of malleable strands of metal bend into a uniform, consistent bend interlocking pattern within the bullet core swaging die, and in doing so, as the unoccupied area within interior center of the bullet core swaging die decreases, compress and force air, lubricant, and excess metal out the "bleed" holes which in turn forms the tightly compressed, uniform interlocking cylindrical core. The plurality of malleable strands of metal are of a length such that the bullet core swaging die allows a small amount of "bleed-off" as each cylindrical core is formed in the bullet core swaging die by means of the swaging process.

A second step of the low-impact swaging process comprises placing the cylindrical core in the jacket and swaging a second time with the jacket in a separate die, forming the cylindrical core to the identification of the jacket. Following the second swaging step, neither the length or volume of the bullet core completely fills the interior of the jacket.

A third step of the low-impact swaging process comprises the utilization of a point forming die which transforms the jacket and the bullet core within the jacket into the final desired highly separable bullet shape.

It is an object of the present invention to provide a highly separable bullet which disintegrates in a controlled fashion and a method of fabrication thereof, which bullet, when fired from a gun, maintains a highly accurate trajectory path.

Also, another object of the present invention is to provide a highly separable bullet which disintegrates in a controlled fashion and a method of fabrication thereof, which bullet, when fired from a gun into soft tissue, water or ballistic geletin as such, will substantially fragment into its individual strands of malleable material in a controlled, uniform, predictable manner.

Further, another object of the present invention is to provide a highly separable bullet which disintegrates in a controlled fashion and method of fabrication thereof, which bullet, when fired from a gun into soft tissue, water or ballistic geletin as such, will fragment and disintegrate in and will not exit the soft tissue water or ballistic geletin as such.

Yet, another object of the present invention is to provide a highly separable bullet which disintegrates in a controlled fashion and method of fabrication thereof, which bullet, when fired from a gun, will not pass through soft tissue, water or ballistic geletin as such and impact non-targeted objects such as people and the like.

Further objects and advantages of the present invention will become apparent as the description proceeds and when taken in conjunction with the accompanying drawings wherein:

DESCRIPTION OF THE PREFERRED EMBODIMENT

Figure 1:
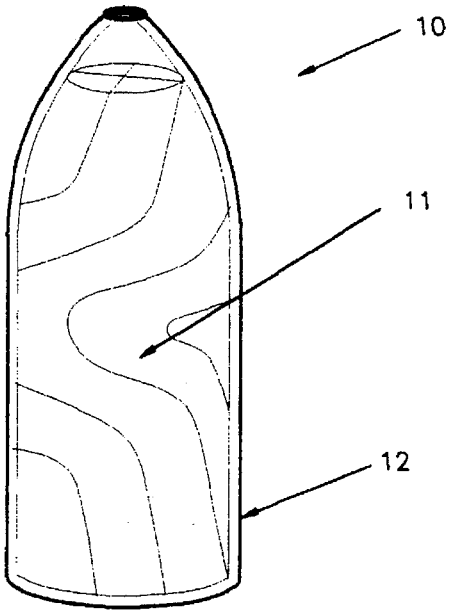
FIG. 1 is a side elevational view of the bullet of the present invention.

Referring now to FIG. 1 there is shown a highly separable bullet 10 which disintegrates in a controlled fashion comprising a bullet core 11 and a jacket 12, which highly separable bullet 10 is fabricated by method comprising a three step low-impact swaging process.

Figure 2:
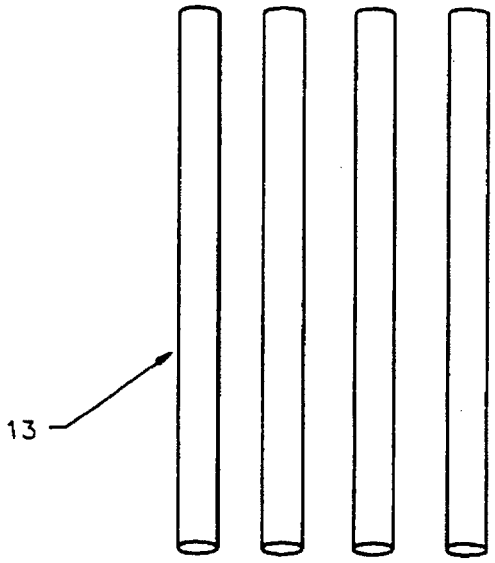
FIG. 2 is a plan view of the unswaged plurality of malleable strands of metal.

As FIG. 2 illustrates, the bullet core 11 further comprises a plurality of malleable strands of metal 13 such as lead, lead alloy, or other such malleable metal, all of which plurality of malleable strands of metal 13 are of equal length and diameter with each other and are swaged into a cylindrical core 11*a* having a unique, uniform interlocking pattern 21 between the plurality of malleable strands of metal 13 as described hereinbelow. The plurality of malleable strands of metal 13 are of varying diameter and length as determined by the caliber and weight of the highly separable bullet 10 in relation to the purpose for which the highly separable bullet 10 is to be utilized. By varying the diameter and number of malleable strands of metal 13 per bullet core 11, a bullet may be custom designed for various penetration depths. For example, a greater number of malleable strands of metal 13 having smaller individual diameter provides for less penetration and large disintegration pattern or wound cavity, and lesser number of malleable strands of metal 13 having larger individual diameter provides for more penetration and small disintegration pattern or wound cavity. Optimal results are obtained when the plurality of malleable strands of metal 13 comprises two to ten strands for most common bullet calibers and weights, but use of more than ten strands is possible.

By way of illustration and not limitation, one embodiment of the bullet core 11 comprises a plurality of malleable strands of metal 13 having the combination of lead and 1½% Sb Antimony, said plurality of malleable strands of metal 13 being of varying diameter and cut to a predetermined length as determined by the caliber and weight of the highly separable bullet 10 in relation to the purpose for which the highly separable bullet 10 is to be utilized.

The highly separable bullet 10 has a jacket 12 which encloses and constrains the bullet core 11 and provides shape for the highly separable bullet 10. The jacket 12 has a generally conventional configuration of a hollow cylinder having a uniform wall thickness of within 0.0002 inches uniformity thereof. The jacket 12 further has an enclosed one end 12*a* thereof, an open one end 12*b* thereof, and a length greater than the predetermined length of the bullet core 11 to be placed therein. The jacket 12 is formed by means, such as a several step drawing process, whereby the finished jacket 12 has the required uniform wall thickness, which uniform wall thickness is critical for accuracy and performance of the highly separable bullet 10. The jacket 12 further has an inner circumference of the jacket wall which inner circumference is compatible and only marginally larger than the outer circumference of the bullet core 11 to be placed therein.

Figure 3:
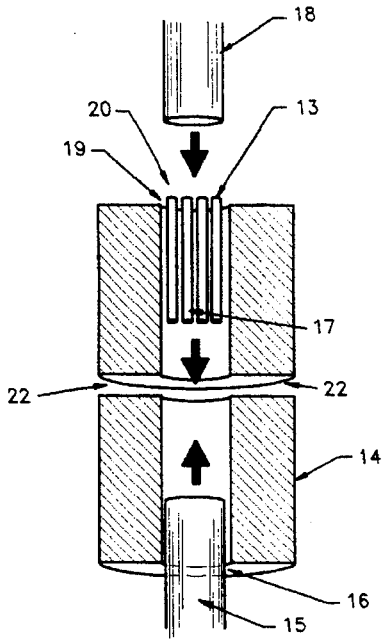
FIG. 3 is side elevational view illustrating a preliminary stage in the first step of the three step low-impact swaging process showing the plurality of malleable strands of metal being positioned in the bullet core swaging die.
Figure 4:
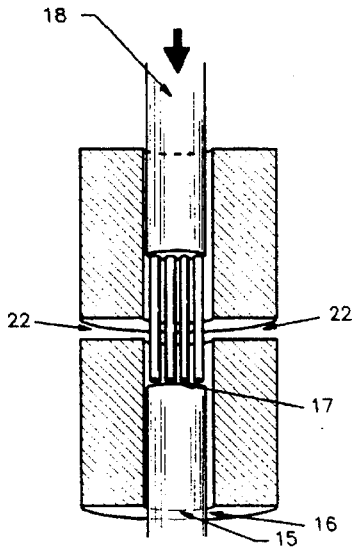
FIG. 4 is a side elevational view illustrating the plurality of malleable strands of metal positioned between the stripper punch and the top punch within the bullet core swaging die.
Figure 5:
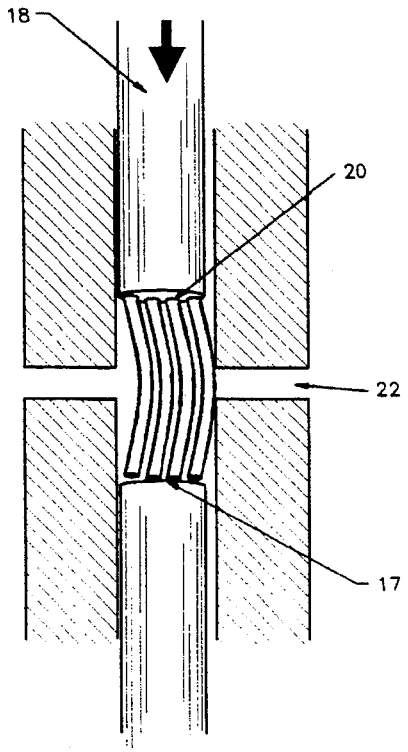
FIG. 5 is a side elevational view illustrating the initiation of the unique, uniform interlocking pattern between the plurality of malleable strands of metal in the bullet core swaging die.
Figure 6:
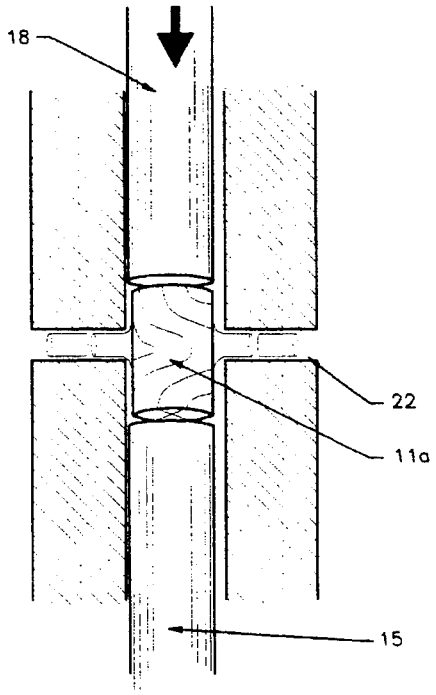
FIG. 6 is a side elevational view illustrating the cylindrical core as swaged into the unique, uniform interlocking pattern between the plurality of malleable strands of metal in the bullet core swaging die.
Figure 7:
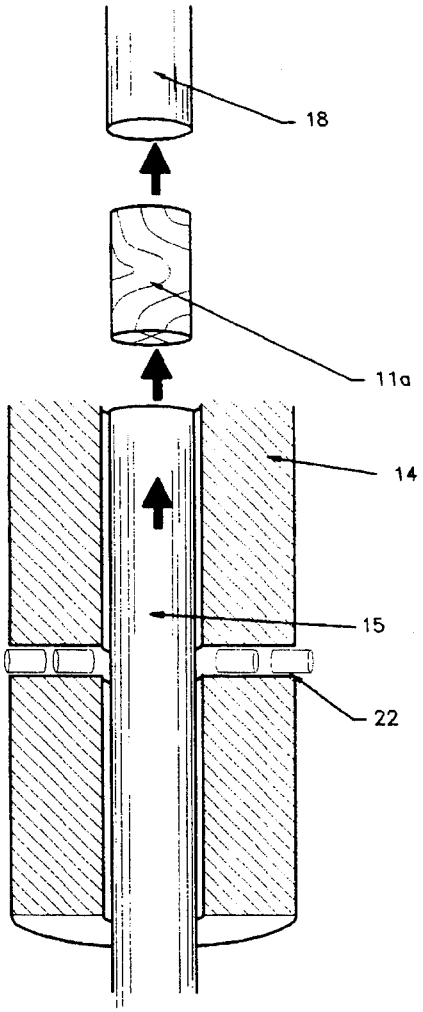
FIG. 7 is a side elevational view illustrating the cylindrical core as swaged into the unique, uniform interlocking pattern between the plurality of malleable strands of metal in the bullet core swaging die being removed from the bullet core swaging die and the excess being sheared off within the bullet core swaging die at the "bleed" holes.
Figure 9:
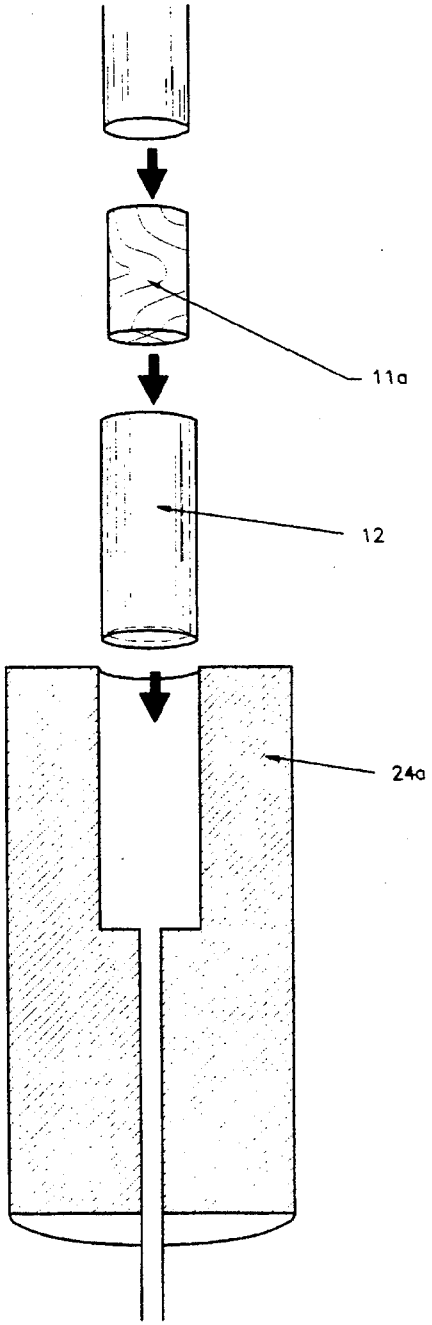
FIG. 9 is a side elevational view illustrating the initiation of the second step of the low-impact swaging process showing the cylindrical core, the jacket and the conforming die.

As FIG'S. 3 through 14 illustrate, a method of fabricating the highly separable bullet 10 which disintegrates in a controlled fashion is provided, which method comprises a three step low-impact swaging process to produce the final highly separable bullet 10. The three step low-impact swaging process further comprises a first step bullet core swaging process as illustrated in FIG'S 3 through 7. FIG. 3 illustrates that the first step bullet core swaging process is a low-impact swaging process comprising placing a preselected number of a plurality of malleable strands of metal 13 in a bullet core swaging die 14 and swaging the plurality of malleable strands 13 of the bullet core 11 into a cylindrical core 11*a* having a unique, uniform interlocking pattern between the plurality of malleable strands of metal 13. The first step bullet core swaging process causes the plurality of malleable strands of metal 13 to coalesce and interlock into the cylindrical core 11*a* as described hereinbelow. FIG. 4 illustrates that the first step bullet core swaging process further comprises securing a stripper punch 15 in a first end 16 of the bullet core swaging die 14, which stripper punch 15 secures a plurality of first ends 17 of the plurality of malleable strands of metal 13 in position in the bullet core swaging die 14 throughout the bullet core swaging process. A minute amount of lubricant is applied to the plurality of malleable strands of metal 13 positioned in the bullet core swaging die 14. The first step bullet core swaging process further comprises positioning a top punch 18 in a second end 19 of the bullet core swaging die 14, and slowly and uniformly applying pressure in a direction proximate to the plurality of first ends 17 of the plurality of malleable strands of metal 13 by means of the top punch 19 to a plurality of second ends 20 of the plurality of malleable strands of metal 13 positioned in the bullet core swaging die 14. The plurality of first ends 17 of the plurality of malleable strands of metal 13 are secured in place in the bullet core swaging die 14 by the stripper punch 15 as pressure is applied by means of the top punch 18 to the plurality of second ends 20 of the plurality of malleable strands of metal 13. FIG. 5 illustrates that pressure applied by means of the top punch 18 to the plurality of second ends 20 of the plurality of malleable strands of metal 13 forces the plurality of second ends 20 in a direction proximate the plurality of first ends 17 of the plurality of malleable strands of metal 13 within the bullet core swaging die 14. FIG.6 illustrates that as the plurality of second ends 20 of the plurality of malleable strands of metal 13 are forced in the direction proximate the plurality of first ends 17 of the plurality of metal strands of metal 13 within the bullet core swaging die 14, the plurality of malleable strands of metal 13 transform into a cylindrical core 11*a* having a uniform, consistent bend interlocking pattern 21.

Figure 8:
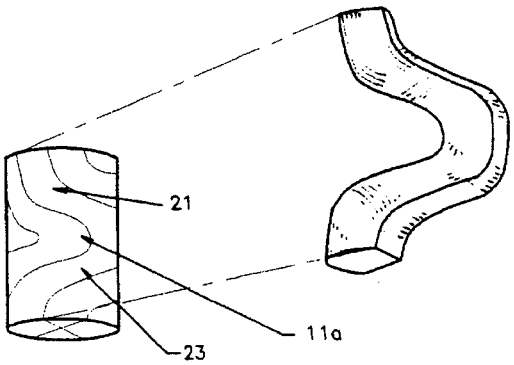
FIG. 8 is a side elevational view of the cylindrical core of the present invention.
Figure 10:
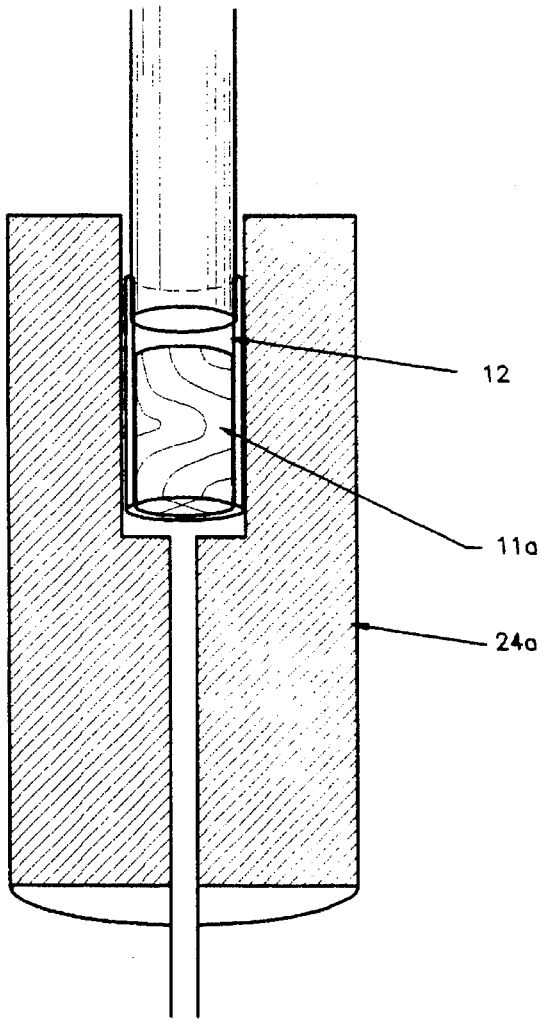
FIG. 10 is a side elevational view illustrating the second step of the low-impact swaging process showing the cylindrical core swaged to conform to the jacket.

FIG. 8 illustrates that the uniform, consistent bend interlocking pattern 21 consists of a center length of each and every of the plurality of malleable strands of metal 13 individually and all of the plurality of malleable strands of metal uniformly bending in the same direction and to the same degree within the bullet core swaging die 14 as the pressure is slowly and uniformly applied by means of the top punch 18. As pressure is slowly and uniformly applied to the plurality of malleable strands of metal 13 by means of the top punch 18, the center length of each and every of the plurality of malleable strands of metal 13 bends in a uniform, consistent manner forming a cylindrical core 11*a* having a uniform, consistent bend interlocking pattern 21 within the bullet core swaging die 14. The uniform interlocking bullet core interlock pattern 21 is such that both the first ends 17 and second ends 20 of each and every of the plurality of malleable strands of metal 13 are positioned on a line drawn longitudinally individually through each of the first ends 17 and second ends 20 of each and every of the plurality of malleable strands of metal 13 through the cylindrical core 11*a*, and the extreme outer point 23 of the uniform, consistent bend interlocking pattern 21 of each and every of the plurality of malleable strands of metal 13 is located 180 degrees from the line drawn longitudinally through each of the first ends 17 and second ends 20 of each and every of the plurality of malleable strands of metal 13 of the cylindrical core 11*a*. The uniform, consistent bend interlocking pattern 21 of each and every of the plurality of malleable strands of metal 13 is necessary to allow the bullet core 11 to maintain integrity during firing and flight as well as to allow for controlled disintegration upon impact.

The bullet core swaging die 14 has a plurality of "bleed" holes 22 which radiate from the interior of the bullet core swaging die 14 to the exterior of the bullet core swaging die 14, which "bleed" holes 22 are located and exit circumferentially at the midlength of the bullet core swaging die 14. As pressure is slowly and uniformly applied to the plurality of malleable strands of metal 13 by means of the top punch 18, the unoccupied area within the interior center of the bullet core swaging die 14 decreases as the uniform, consistent bend interlocking pattern 21 of each and every of the plurality of malleable strands of metal 13 forms, and air, lubricant, and excess metal are forced out the "bleed" holes 22 which results in the formation of the tightly compressed, uniform interlocking cylindrical core 11*a*. The plurality of malleable strands of metal 13 are cut to length such that the bullet core swaging die 14 allows a small amount of "bleed-off" of air, lubricant and metal through the "bleed" holes 22 as each cylindrical core 11*a* is formed in the bullet core swaging die 14 by means of the first step bullet core swaging process. The total weight of the plurality of malleable strands of metal 13 comprising the cylindrical core 11*a* prior to the first step bullet core swaging process exceeds the weight of the intended finished bullet core 11.

Figure 11:
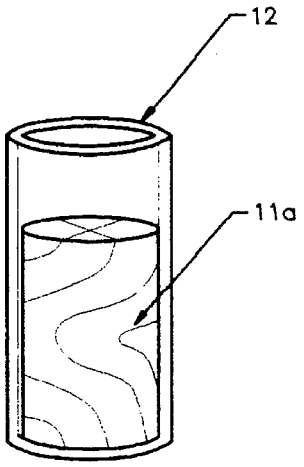
FIG. 11 is a side elevational view of the cylindrical core of the present invention swaged to conform to the jacket.
Figure 12:
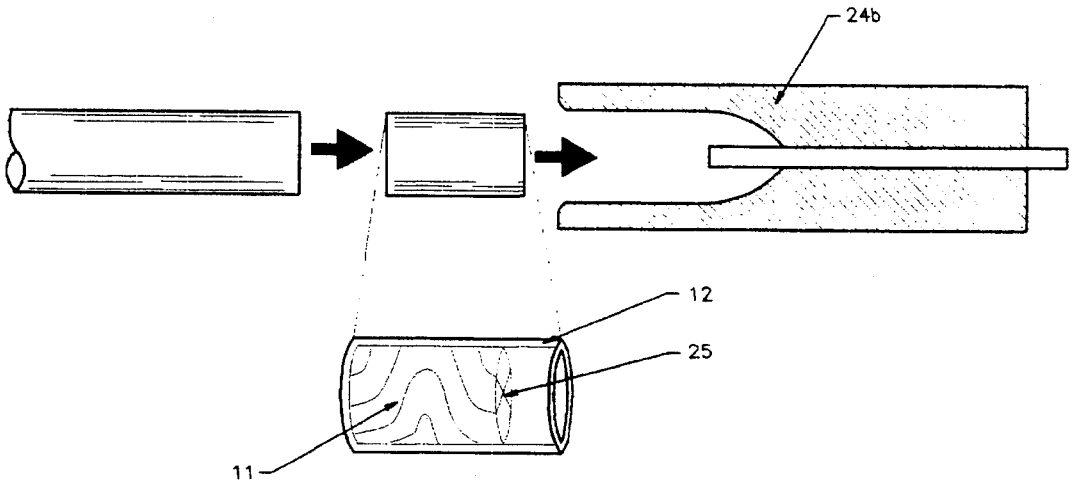
FIG. 12 is a side elevational view illustrating the initiation of the third step of the low-impact swaging process showing the cylindrical core swaged to conform to the jacket and the point forming die.
Figure 13:
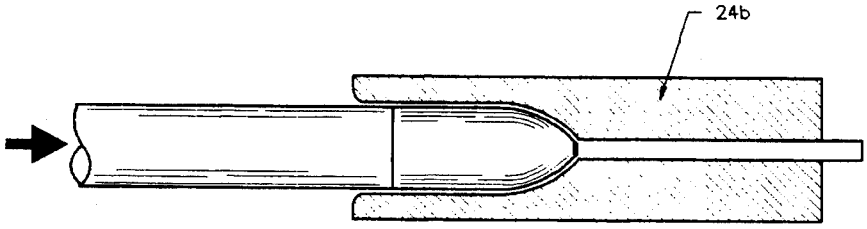
FIGS. 13 and 14 are side elevational views illustrating the third step of the low-impact swaging process showing the cylindrical core swaged to conform to the jacket being swaged into a highly separable bullet.

FIG'S. 9 and 10 illustrate that a second step of the low-impact swaging process comprises placing the cylindrical core 11*a* in the jacket 12 and swaging the jacket 12 and the cylindrical core 11*a* within the jacket 12 a second time in a conforming die 24*a*, which swaging in the conforming die 24*a* forms the cylindrical core 11*a* to the identification of the jacket 12 of the highly separable bullet 10. FIG. 11 illustrates that after the second swaging step, neither the length or volume of the bullet core 11 completely fills the interior of the jacket 12.

Figure 14:
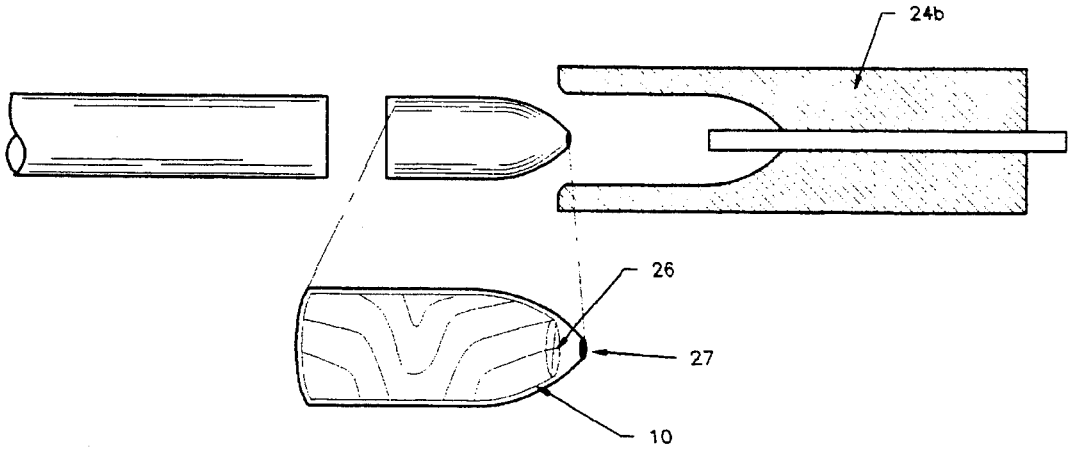

FIG'S. 12 through 14 illistrate that a third step of the low-impact swaging process comprises the utilization of a point forming die 24*b* which transforms the jacket 12 and the bullet core 11 within the jacket 12 into the final desired highly separable bullet 10 shape. In the third step of the low-impact swaging process utilizing the point forming die 24*b*, the outer end 25 of the bullet core 11, is slightly reformed with the pointing of the jacket 12 in the point forming die 24*b*. FIG. 14 illustrates that in the third step of the low-impact swaging process utilizing the point forming die 24*b*, the bullet core 11 does not completely fill the interior of the jacket 12, but rather provides for a space 26 at the point 27 of the highly separable bullet 10 which facilitates quick disintegration of the bullet core 11 upon impact, but only upon impact.

A highly separable bullet 10 is provided which easily, consistently, and predictably separates, fragments and disintegrates in a controlled fashion after entering soft tissue, water or ballistic geletin as such. The highly separable bullet 10 thus produced is capable of withstanding the inflight centrifugal force produced by the rifling twist of the barrel of the weapon upon firing, and not separating and fragmenting until impact, said separation and fragmentation being uniform, consistent and predictable. The highly separable bullet 10 can be effectively fired up to at least 4000 feet per second from a gun and is highly accurate for long distances because the highly separable bullet 10 comprises the bullet core 11 and jacket 12 which do not shift during the flight and rotation of the highly separable bullet 10.

The highly separable bullet 10 will begin to fragment upon impact and fragment into the plurality of malleable strands of metal 13 within approximately eight inches after entering soft tissue, water or ballistic geletin as such. Upon impact with the highly separable bullet 10, the soft tissue, water or ballistic geletin as such enters the space 26 at the point 27 of the highly separable bullet 10 and effects pressure thereof relative to the speed of the highly separable bullet 10, causing the jacket 12 to shear away and the bullet core 11 to effectively fragment into the plurality of malleable strands of metal 13 individually, which plurality of malleable strands of metal 13 individually elongate as they move through the soft tissue, water or ballistic geletin as such. The plurality of malleable strands of metal 13 essentially do not exit the soft tissue, water or ballistic geletin as such, but remain within thereof which, by doing so, substantially prevents non-targeted objects from also getting hit by the highly separable bullet 10 or particles thereof.

Thus, the highly separable bullet 10 has an entirely conventional appearance and may be inserted in the usual manner into a cartridge case (not shown) containing a powdery charge and a primer. It will be understood, however, that the present invention is concerned only with the highly separable bullet 10 and the method of fabrication thereof.

Various changes and departures may be made to the invention and method of fabrication thereof without departing from the spirit and scope thereof. Accordingly, it is not intended that the invention and method of fabrication thereof be limited to that specifically described in the specification or as illustrated in the drawings but only as set forth in the claims. From the drawings and above-description, it is apparent that a highly separable bullet constructed in accordance with the invention and method herein provides desirable features and advantages. While the form of the highly separable bullet and method herein described constitutes a preferred embodiment of the invention, it is to be understood that the highly separable bullet and method herein are capable of further modification, and this application is intended to cover any variations, uses, or adaption of the highly separable bullet and method herein, following in general the principles of the highly separable bullet and method herein and include such departures from the present disclosure as to come within knowledge or customary practice in the art to which the highly separable bullet and method herein pertain, and as may be applied to the essential features hereinbefore set forth and falling within the scope of the highly separable bullet and method herein or the limits of the appended claims.

What is claimed and desired to be secured by United States Letters Patent is:

1. A highly separable bullet comprising a bullet core and a jacket, said jacket having said bullet core swaged therein and a uniform wall thickness enclosing and constraining said bullet core, said bullet core having a plurality of 2 to 10 malleable strands of metal of equal length and diameter with each other swaged into a cylindrical core, said cylindrical core having a unique, uniform interlocking pattern between the plurality of malleable strands of metal, said unique, uniform interlocking pattern between the plurality of malleable strands of metal having a uniform, consistent bend interlocking pattern whereby a first end and a second end of each and every of said plurality of 2 to 10 malleable strands of metal are positioned on a longitudinal line through each and every of said first end and said second end of each and every of said plurality of 2 to 10 malleable strands of metal and an extreme outer point of said uniform, consistent bend interlocking pattern of each and every of said plurality of 2 to 10 malleable strands of metal is located 180 degrees from said longitudinal line through each and every of said first end and said second end of each and every of said plurality of 2 to 10 malleable strands of metal.

* * * * *